US009847206B2

(12) United States Patent
Jajtic et al.

(10) Patent No.: US 9,847,206 B2
(45) Date of Patent: Dec. 19, 2017

(54) ROTARY ANODE ARRANGEMENT AND X-RAY TUBE

(71) Applicant: SIEMENS AKTIENGESELLSCHAFT, München (DE)

(72) Inventors: Zeljko Jajtic, München (DE); Thomas Weidinger, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 178 days.

(21) Appl. No.: 14/413,638

(22) PCT Filed: Apr. 24, 2013

(86) PCT No.: PCT/EP2013/058528
§ 371 (c)(1),
(2) Date: Jan. 8, 2015

(87) PCT Pub. No.: WO2014/009034
PCT Pub. Date: Jan. 16, 2014

(65) Prior Publication Data

US 2015/0170870 A1 Jun. 18, 2015

(30) Foreign Application Priority Data

Jul. 11, 2012 (DE) ..... 10 2012 212 133

(51) Int. Cl.
*H01J 35/10* (2006.01)

(52) U.S. Cl.
CPC ..... *H01J 35/103* (2013.01); *H01J 35/101* (2013.01); *H01J 2235/1026* (2013.01); *H01J 2235/1073* (2013.01)

(58) Field of Classification Search
CPC ..... H01J 2335/1026; H01J 2335/1073; H01J 35/101; H01J 35/103; H02K 1/17; H02K 1/04
See application file for complete search history.

(56) References Cited

U.S. PATENT DOCUMENTS 4,322,624 A 3/1982 Cornelissen et al.
4,468,801 A 8/1984 Sudo et al.
(Continued)

FOREIGN PATENT DOCUMENTS

CN 1574181 A 2/2005
CN 101154550 A 4/2008
(Continued)

OTHER PUBLICATIONS

Wang, "Reduction of Cogging Torque in Permanent Magnet Flux-Switching Machines", Mar. 2009, Scientific Research Publishing, vol. 1, pp. 11-14.*
(Continued)

*Primary Examiner* — David J Makiya
*Assistant Examiner* — Soorena Kefayati
(74) *Attorney, Agent, or Firm* — Lempia Summerfield Katz LLC

(57) ABSTRACT

The embodiments relate to a rotary anode arrangement with a rotary anode, a rotor for driving the rotary anode and a stator, which exerts a torque on the rotor. The stator includes at least one coil for generating a first magnetic field and at least one permanent magnet for generating a second magnetic field. The embodiments also relate to an X-ray tube with the rotary anode arrangement. The embodiments offer the advantage that a high electromagnetic utilization is possible with a synchronous motor that is excited by permanent magnets.

10 Claims, 2 Drawing Sheets

(56) References Cited

U.S. PATENT DOCUMENTS

| | | | | |
|---|---|---|---|---|
| 5,034,643 | A * | 7/1991 | Trian | H02K 3/345 310/215 |
| 5,185,774 | A | 2/1993 | Klostermann | |
| 5,327,069 | A * | 7/1994 | Radun | H02K 29/12 318/400.13 |
| 5,490,198 | A * | 2/1996 | Gerling | H05G 1/66 378/131 |
| 6,141,401 | A | 10/2000 | Gerling | |
| 6,198,803 | B1 * | 3/2001 | Osama | F16C 32/047 378/125 |
| 6,570,960 | B1 * | 5/2003 | Kuzniar | H01J 35/101 378/121 |
| 6,777,842 | B2 * | 8/2004 | Horst | H02K 21/44 310/154.11 |
| 7,122,933 | B2 * | 10/2006 | Horst | H02K 3/18 310/179 |
| 8,069,550 | B2 * | 12/2011 | Gadelmeier | H02K 41/033 29/596 |
| 8,076,815 | B2 * | 12/2011 | Freudenberg | H02K 41/033 310/12.01 |
| 8,384,232 | B2 * | 2/2013 | Myers | H02K 7/09 290/52 |
| 2002/0121831 | A1 * | 9/2002 | Egawa | H02K 1/24 310/216.001 |
| 2004/0084989 | A1 * | 5/2004 | Schunk | H02K 1/148 310/216.012 |
| 2004/0240614 | A1 | 12/2004 | Tiwari et al. | |
| 2008/0030108 | A1 * | 2/2008 | Trago | H02K 37/20 310/49.01 |
| 2008/0080672 | A1 | 4/2008 | Anno | |
| 2010/0033043 | A1 | 2/2010 | Seki et al. | |
| 2010/0289387 | A1 * | 11/2010 | Tanaka | H02K 23/66 310/68 B |

FOREIGN PATENT DOCUMENTS

| | | | |
|---|---|---|---|
| CN | 101461120 | A | 6/2009 |
| CN | 102449335 | A | 5/2012 |
| DE | 19752114 | A1 | 5/1999 |
| DE | 102004045992 | A1 | 4/2006 |
| DE | 102011077746 | A1 | 4/2012 |
| WO | WO2006032638 | A1 | 3/2006 |
| WO | WO2010136325 | A2 | 12/2010 |

OTHER PUBLICATIONS

Chinese Office action for related Chinese Application No. 201380023987.2, dated Dec. 7, 2015, with English Translation.

German Office Action dated Feb. 20, 2013 for corresponding German Patent Application No. DE 10 2012 212 133.1 with English translation.

PCT International Search Report and Written Opinion cited in PCT/EP2013/058528, dated Aug. 2, 2013.

* cited by examiner

FIG 1 STATE OF THE ART
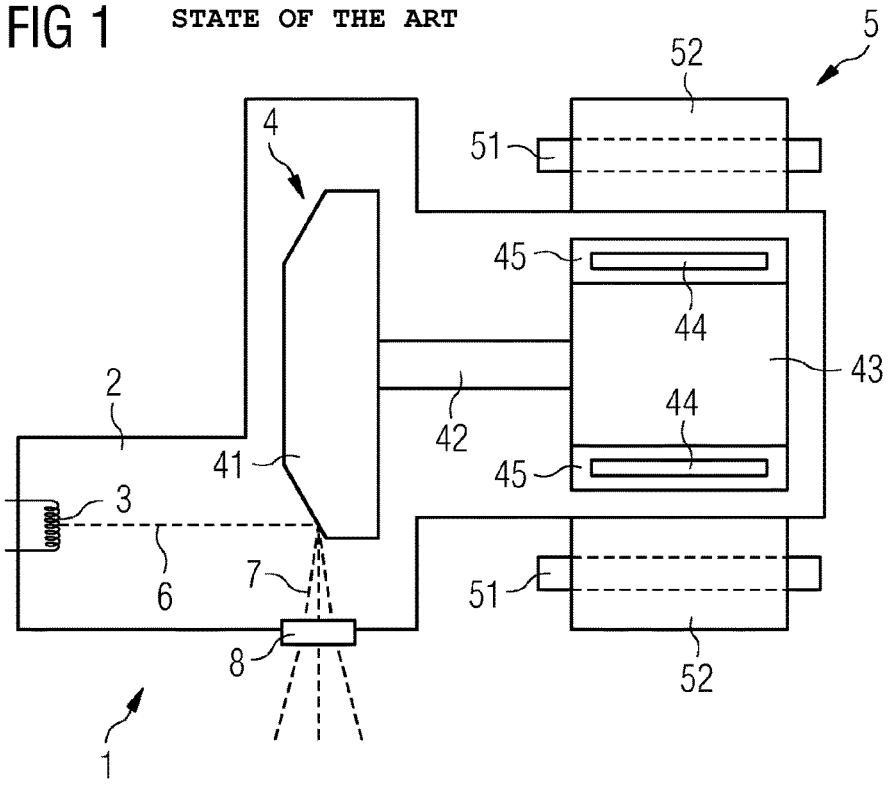
FIG 2
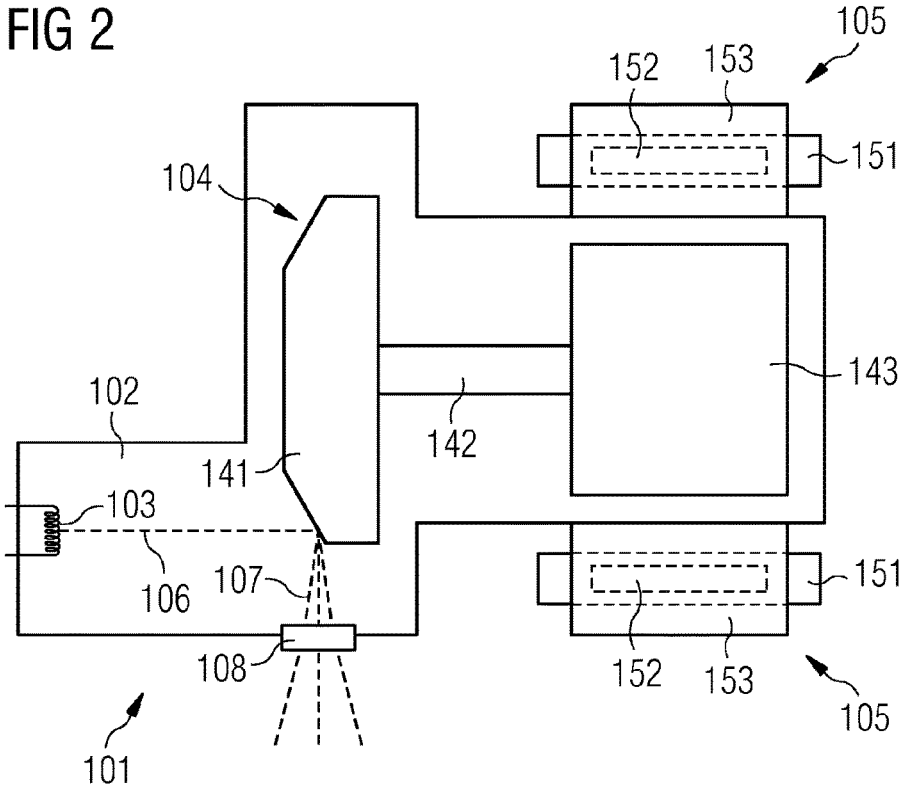

ROTARY ANODE ARRANGEMENT AND X-RAY TUBE

CROSS-REFERENCE TO RELATED APPLICATIONS

The present patent document is a §371 nationalization of PCT Application Serial Number PCT/EP2013/058528, filed Apr. 24, 2013, designating the United States, which is hereby incorporated by reference, and this patent document also claims the benefit of DE 10 2012 212 133.1, filed on Jul. 11, 2012, which is also hereby incorporated by reference.

TECHNICAL FIELD

The embodiments relate to an arrangement including a rotary anode having a rotor for driving the rotary anode, and including a stator that exerts a torque on the rotor by magnetic force. The embodiments also relate to an X-ray tube including the rotary anode arrangement.

BACKGROUND

X-ray radiation may be generated by bombardment of an anode with an electron beam emerging from a cathode. The cathode and the anode are in this case arranged in a vacuum housing of an X-ray tube. X-ray tubes may be provided with a rotary anode that rotates away on impingement of the electron beam in order to avoid a focal spot that is stationary with respect to the anode. The focal spot, (i.e., the point at which the electron beam impinges on the anode surface), is shifted along a circular path over the anode surface from the point of view of a coordinate system rotating with the rotary anode. As a result, the lost heat generated on impingement of the electron beam is distributed comparatively uniformly over the anode surface, as a result of which possible overheating of the material at the focal spot is counteracted.

The X-ray rotary anode of known X-ray tubes is driven by an asynchronous motor, which is fed by an inverter. The rotor of the asynchronous motor is coupled to the rotary anode and is located within the vacuum envelope of the X-ray tube. Such a drive apparatus is disclosed, for example, in DE 197 52 114 A1.

Three windings offset with respect to one another through 120° are arranged in the stator of the asynchronous motor, for example. The rotor includes a magnetic return path, and an electrically conductive material, which is arranged as a cage or bell. The magnetic return path may also be embodied fixedly. If a sinusoidal electric current is flowing in the windings of the stator and there is a phase shift of 120° between the currents, a rotating magnetic field is formed in the stator of the motor. This magnetic field passes through the rotor. The rotating magnetic field induces an electric voltage in the conductors of the rotor. Since the conductors are short-circuited owing to their embodiment as a cage, the induced voltage brings about a current flow in the rotor. The rotor current builds up a dedicated magnetic field that interacts with the rotating magnetic field of the stator. A torque acts on the rotor, as a result of which the rotor implements a rotary movement and follows the rotation of the stator field.

The rotor, however, does not follow the rotating magnetic stator field synchronously, but rotates at a lower speed. The relative movement of the rotor and the stator field is necessary since only then is a current flow induced in the rotor and may the rotor build up its dedicated magnetic field. The rotor therefore rotates "asynchronously" with respect to the stator field. There is a slip between the frequency of the stator field and the rotational frequency of the rotor. The magnitude of the slip is dependent on the loading and on the size of the air gap between the rotor and the stator. During no-load operation, the slip is only low.

The air gap between the windings of the stator and the rotor is very small in the case of conventional asynchronous motors. In the case of an X-ray tube, however, a mechanically larger air gap is desired since there is a tube sleeve between the stator and the rotor, which tube sleeve provides the tube vacuum. If the rotor is additionally also at a high-voltage potential, an even larger distance needs to be maintained with respect to the stator in order to provide electrical insulation. The large air gap between the rotor and the stator has the effect that the magnetic flux density of the stator is low at the location of the rotor. The available torque is low since the Lorentz force on the rotor is low in comparison with a conventional asynchronous motor.

Also problematic are the eddy currents in the rotor of an asynchronous machine since they generate additional lost heat in the X-ray tube. The heat of the rotor needs to be dissipated, which is difficult as a result of the prevailing vacuum. In addition, the heating results in an increase in the resistivity of the rotor material, as a result of which the torque on the rotor is additionally reduced.

In principle, an asynchronous machine with a large air gap has a power factor of less than 0.5. That is to say that the motor draws a large quantity of reactive power, as a result of which the current amplitude becomes very high. DE 10 2011 077 746 A1 proposes providing a rotary anode of an X-ray tube with a synchronous drive. A rotor including a permanently magnetic material is used in place of a squirrel-cage rotor of an asynchronous drive. If the rotor is magnetized, the permanent magnets generate a standing magnetic field with respect to the rotor. The rotor rotates synchronously with a rotating magnetic field generated by a stator.

DE 10 2011 077 746 A1 discloses a rotary anode for an X-ray tube including a rotor for driving the rotary anode, wherein a magnetic field of a stator winding exerts a torque on at least one permanent magnet arranged in the rotor. The advantage of the synchronous drive includes that eddy current losses are minimized in the rotor and the power factor cos $\phi$ tends towards 1. As a result a rotary anode may be driven more efficiently.

FIG. 1 depicts a longitudinal section through the X-ray tube including a synchronous drive in accordance with DE 10 2011 077 746 A1. In an evacuated tube sleeve 2 of an X-ray tube 1, there is an electron-emitting cathode 3 and a rotary anode 4 opposite said cathode. The rotary anode 4 includes an anode plate 41, which is connected to a rotor 43 of an electric motor by a shaft 42. Magnetized permanent magnets 44 are arranged in the rotor material 45 of the rotor 43 and generate a magnetic field that rotates along with the rotor 43.

Outside the tube sleeve 2, a stator 5 surrounds the tube sleeve 2 in the direct vicinity of the rotor 4. The stator 5 generates, with its stator windings 51 through which current is flowing, a magnetic field rotating about the tube sleeve 2. That stator 5 also exerts a torque on the rotor 43 and therefore causes the rotary anode 4 to rotate synchronously corresponding to the remarks made in respect of FIG. 1. The stator windings 51 are arranged in a laminate stack 52.

The electron beam 6 emitted by the cathode is accelerated towards the anode plate 41 and, on impingement on the anode plate 41, generates X-ray radiation 7 owing to deceleration, which X-ray radiation leaves the X-ray tube 1 through a beam window 8 in the tube sleeve 2.

Temperatures of over 300° C. occurring during operation of the X-ray tube and temperatures during manufacture of the X-ray tube of up to 600° C. may be problematic for the permanent magnet of the rotor.

U.S. Pat. No. 4,322,624 A discloses a rotary anode including an electric-motor rotary anode drive including a coil and a permanent magnet.

WO 2010/136325 A2 discloses an axial hybrid bearing that includes a permanently magnetic bearing for generating a repulsive force and an electromagnetic part for generating an attractive force.

SUMMARY AND DESCRIPTION

The scope of the present invention is defined solely by the appended claims and is not affected to any degree by the statements within this summary. The present embodiments may obviate one or more of the drawbacks or limitations in the related art.

The object of the embodiments therefore includes specifying a further rotary anode arrangement that provides an alternative to known solutions.

The embodiments include driving a rotary anode in accordance with the principle of a synchronous motor, wherein a stator for generating a magnetic excitation field, which interlinks the stator with a rotor, includes permanent magnets and coils. The rotor has only a soft-magnetic structure. As a result, those lost components in the copper of a stator coil and in the copper cylinder of the rotor that may occur in the case of a comparable asynchronous machine as a result of the current for generating a magnetic excitation flux are lost. It is also advantageous that a large air gap is possible, with the result that sufficient space may be provided for the tube sleeve. Advantageously, the rotor does not have permanent magnets, whose magnetic properties may be permanently impaired at the high temperatures to which the rotor is subjected during operation and during manufacture.

The embodiments provide a rotary anode arrangement, the rotary anode arrangement including a rotary anode, a stator including a stator housing, which exerts a torque on the rotor, a plurality of coils arranged in a stator for generating a first magnetic field, a plurality of permanent magnets arranged in the stator for generating a second magnetic field, and a rotor arranged within the stator for driving the rotary anode. The coils and the permanent magnets are arranged along the circumference of the stator housing, wherein in each case one permanent magnet is arranged within in each case one coil.

The rotor is designed for a magnetic return path and is free of magnetic sources, and the rotor has a toothed structure in the direction of rotation of the rotor.

The embodiments provide the advantage that, owing to this synchronous drive arrangement, fewer losses occur than in the case of asynchronous motors because it is not necessary to use a current for generating a magnetic flux in the rotor. In addition, the efficiency cos $\phi$ is close to 1, which in turn results in lower currents and therefore in lower losses in an upstream converter. The installation space may also be markedly reduced in size since the permanent magnet synchronous motor has much higher electromagnetic utilization than a comparable asynchronous motor. The improved efficiency also results in reduction of the required installation space.

In one development of the arrangement, the rotor includes a first soft-magnetic material.

In a further embodiment, the arrangement includes a plurality of stator tooth modules, which are arranged at regular intervals along the circumference of the stator housing, wherein the stator tooth modules each include two stator tooth halves including a second soft-magnetic material, wherein the permanent magnets are arranged between the stator tooth halves, and wherein in each case one coil is wound around in each case two stator tooth halves and the permanent magnets positioned therebetween.

Furthermore, the rotary anode may include an anode plate and a shaft bearing the anode plate, wherein the shaft is connected to the rotor.

The embodiments also provide an X-ray tube including a rotary anode arrangement, wherein the rotor is arranged within an X-ray sleeve of the X-ray tube, and the Stator is arranged outside the X-ray sleeve of the X-ray tube.

BRIEF DESCRIPTION OF THE DRAWINGS

FIG. 1 depicts a longitudinal section through an X-ray tube in accordance with the prior art.

FIG. 2 depicts an embodiment of a longitudinal section through an X-ray tube including a rotary anode arrangement.

DETAILED DESCRIPTION

Figure 3:
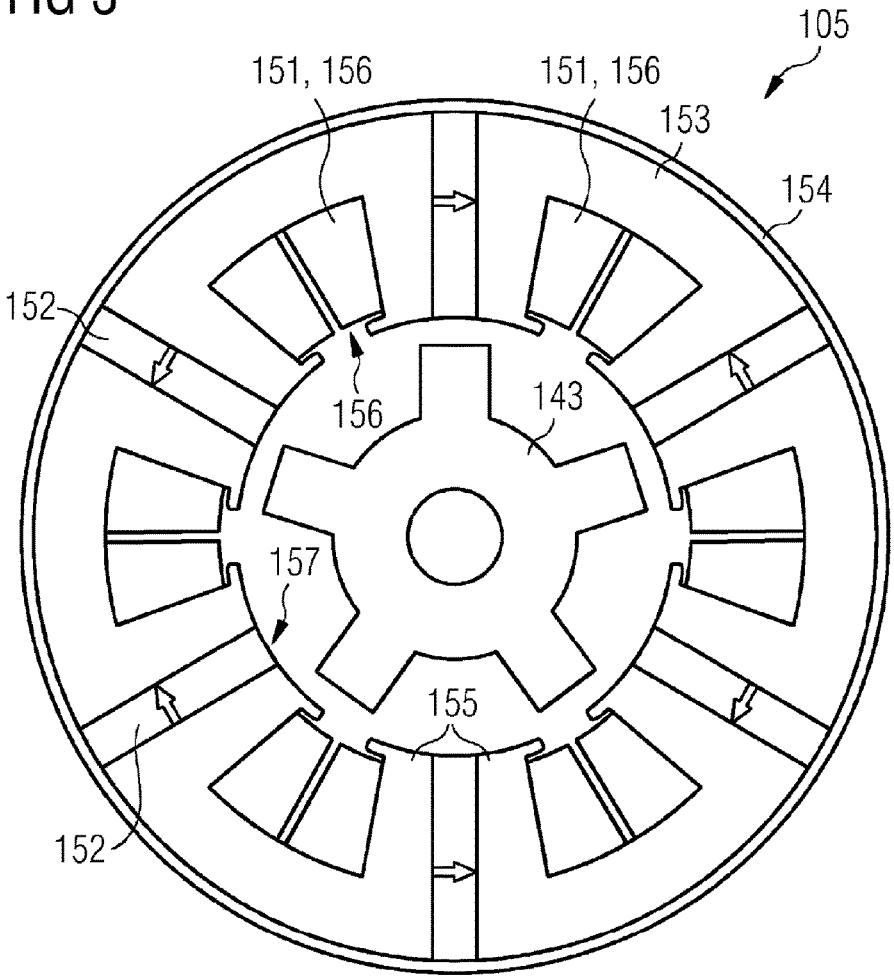
FIG. 3 depicts a cross section through the stator and rotor of the rotary anode arrangement.

FIG. 2 depicts a longitudinal section through an X-ray tube 101 including a rotary anode arrangement. An electron-emitting cathode 103 and a rotary anode 104 opposite said cathode are located in an evacuated tube sleeve 102 of the X-ray tube 101. The rotary anode 104 includes an anode plate 141 connected to a rotor 143 of an electric motor by a shaft 142. The rotor 143 is formed from a first soft-magnetic material. Soft-magnetic materials are, for example, electric or magnetic sheet steel or soft magnetic composite (SMC) materials.

Outside the tube sleeve 102, a stator 105 surrounds the tube sleeve 102 in the direct vicinity of the rotor 104. The stator 105 includes a plurality of permanent magnets 152 arranged along its circumference, which permanent magnets generate a second magnetic field that acts as excitation field on the soft-magnetic rotor 143. The stator 105 generates, with coils 151 through which current is flowing and which are arranged along the circumference, at least one first magnetic field rotating about the tube sleeve 102. The permanent magnets 152 arranged in the stator 105 generate a second magnetic field (e.g., excitation field). By virtue of the interaction of the first and second magnetic fields with the rotor 143, a torque is generated, as a result of which the rotary anode 104 is caused to rotate synchronously. The permanent magnets 152 are arranged in a second soft-magnetic material 153.

The electron beam 106 emitted by the cathode is accelerated towards the anode plate 141 and, on impingement on the anode plate 141, generates X-ray radiation 107 owing to deceleration, which X-ray radiation leaves the X-ray tube 101 through a beam window 108 in the tube sleeve 102.

FIG. 3 depicts a cross section through the stator 105 and the rotor 143 of the rotary anode arrangement as depicted in FIG. 2. The stator 105 includes a magnetically nonconductive cylindrical stator housing 154 in which stator tooth modules 157, including stator tooth halves 155 including a second soft-magnetic material 153, for example motor laminations, are arranged at regular intervals along the circumference of the stator housing 154. Permanent magnets 152 are arranged with alternate polarity between the stator tooth halves 155. A coil 151 including copper wire is wound around in each case two stator tooth halves 155 and a permanent magnet 152, which coil forms a tooth-wound coil 156. The coils 151, owing to the current flowing through them, generate a first magnetic field, and the permanent magnets 152 generate a second magnetic field. Both magnetic fields are closed via the rotor 143, which therefore forms a section of a magnetic circuit of an electric machine.

The first soft-magnetic material of the rotor 143 has a regular tooth-shaped structure. By interaction of the two magnetic fields and the rotor 143, a torque is produced that acts on the rotor 143 and is used to drive the rotary anode.

For example, the stator 105 includes six wound stator tooth modules 157, with in each case one permanent magnet 152 being introduced in the center of said stator tooth modules in a radial on-edge position. The stator tooth modules 157 are wound individually and the stator 105 is constructed from the wound stator tooth modules 157. The individual coils 151 of the stator 105 formed in this way are connected to form a motor winding with three winding phases. By virtue of this modular motor design with the separate winding of the stator tooth modules 157, a high copper space factor of the coils 151 is achieved, as a result of which the efficiency is high.

The operational response and driving of the motor are the same as in any known permanent magnet synchronous machine owing to a sinusoidally induced voltage.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. A rotary anode arrangement comprising:

a rotary anode;

a stator configured to exert a torque on a rotor, the stator comprising a stator housing and a plurality of stator tooth modules arranged at regular intervals along a circumference of the stator housing, wherein each stator tooth module of the plurality of stator tooth modules comprises two stator tooth halves having a first soft-magnetic material;

a plurality of coils arranged in the stator for generating a first magnetic field;

a plurality of permanent magnets arranged in the stator for generating a second magnetic field, wherein the plurality of coils and the plurality of permanent magnets are arranged along a circumference of the stator housing, wherein only a single permanent magnet of the plurality of permanent magnets is arranged in a center of each stator tooth and extending in a radial direction between an end of a respective stator tooth and the circumference of the stator housing, and wherein each respective coil of the plurality of coils is wound around two respective stator tooth halves and the respective permanent magnet positioned therebetween; and the rotor arranged within the stator for driving the rotary anode, wherein the rotor is configured for a magnetic return path and is free of magnetic sources, and wherein the rotor has a toothed structure in a direction of rotation of the rotor.

2. The rotary anode arrangement as claimed in claim 1, wherein the rotor comprises a second soft-magnetic material.

3. The rotary anode arrangement as claimed in claim 1, wherein the rotary anode comprises an anode plate and a shaft bearing the anode plate, wherein the shaft is connected to the rotor.

4. The rotary anode arrangement as claimed in claim 1, wherein adjacent permanent magnets of the plurality of permanent magnets are arranged with alternate polarities.

5. The rotary anode arrangement as claimed in claim 2, wherein the rotary anode comprises an anode plate and a shaft bearing the anode plate, wherein the shaft is connected to the rotor.

6. An X-ray tube comprising:

a rotary anode arrangement comprising:

a rotary anode;

a stator configured to exert a torque on a rotor, the stator comprising a stator housing and a plurality of stator tooth modules arranged at regular intervals along a circumference of the stator housing, wherein each stator tooth module of the plurality of stator tooth modules comprises two stator tooth halves having a first soft-magnetic material;

a plurality of coils arranged in the stator for generating a first magnetic field;

a plurality of permanent magnets arranged in the stator for generating a second magnetic field, wherein the plurality of coils and the plurality of permanent magnets are arranged along a circumference of the stator housing, wherein only a single permanent magnet of the plurality of permanent magnets is arranged in a center of each stator tooth and extending in a radial direction between an end of a respective stator tooth and the circumference of the stator housing, and wherein each respective coil of the plurality of coils is wound around two respective stator tooth halves and the respective permanent magnet positioned therebetween; and the rotor arranged within the stator for driving the rotary anode, wherein the rotor is configured for a magnetic return path and is free of magnetic sources, and wherein the rotor has a toothed structure in a direction of rotation of the rotor, wherein the rotor is arranged within an X-ray sleeve of the X-ray tube, and the stator is arranged outside the X-ray sleeve of the X-ray tube.

7. The X-ray tube arrangement as claimed in claim 6, wherein the rotor comprises a second soft-magnetic material.

8. The X-ray tube arrangement as claimed in claim 6, wherein the rotary anode comprises an anode plate and a shaft bearing the anode plate, wherein the shaft is connected to the rotor.

9. The X-ray tube arrangement as claimed in claim 7, wherein the rotary anode comprises an anode plate and a shaft bearing the anode plate, wherein the shaft is connected to the rotor.

10. The X-ray tube arrangement as claimed in claim 6, wherein adjacent permanent magnets of the plurality of permanent magnets are arranged with alternate polarities.

* * * * *